US005167510A

United States Patent [19]

Plummer

[11] Patent Number: 5,167,510

[45] Date of Patent: Dec. 1, 1992

[54] CROSSPOINT SWITCH MODULE AND MATRIX

[75] Inventor: Cole Plummer, Casco, Me.

[73] Assignee: General Signal Corporation, Stamford, Conn.

[21] Appl. No.: 786,714

[22] Filed: Nov. 1, 1991

[51] Int. Cl.[5] ..... H01R 13/00

[52] U.S. Cl. ..... 439/52

[58] Field of Search ..... 439/52, 53, 578–585, 439/50–51

[56] References Cited

U.S. PATENT DOCUMENTS

| | | | |
|---|---|---|---|
| 2,916,721 | 12/1959 | Adams | 439/50 |
| 3,432,801 | 3/1969 | Ruotolo | 439/51 |
| 4,743,202 | 5/1988 | Bach | 439/53 |

*Primary Examiner*—Joseph H. McGlynn

*Attorney, Agent, or Firm*—Robert R. Hubbard; John F. Ohlandt

[57] ABSTRACT

A radio frequency crosspoint switch module for use in a matrix comprising: a housing adapted to provide grounding; a pair of orthogonally related crosspoint switches disposed within the housing at either end thereof, each crosspoint switch including three movable blade contacts and three sets of fixed contacts, one set of fixed contacts being disposed on, and in contact with, the housing; a pair of coaxial connectors coupled to each of the ends of the housing, each connector having an inner conductor and an outer conductor, each pair of coaxial connectors being disposed on a common axis to be connected in a through connection mode when a respective switch is in a first position, such that two of the movable blade contacts are in contact with the second and third sets of fixed contacts attached to, or forming part of, the inner conductors of the first and second connectors respectively; a third coaxial connector being rotatable, extending between the ends of the housing, and orthogonally related to the two pairs of coaxial connectors, the third coaxial connector being grounded by way of contact of the one set of fixed contacts disposed on the housing with the third of the movable blade contacts, which is affixed to the third coaxial connector, when said crosspoint switches are in their first position; and being connected to one of the other coaxial connectors when the crosspoint switches are in their second, or cross connection, position.

11 Claims, 2 Drawing Sheets

CROSSPOINT SWITCH MODULE AND MATRIX

The present invention relates to a crosspoint switch module and matrix designed to allow a number of transmitters to be connected to a number of antennas in any combination. This unique assembly is completely modular and the number of crosspoints is limited only by the space available.

BACKGROUND OF THE INVENTION

In the past, transmitters have been connected to various antennas to permit scheduling of variations in antenna characteristics. The interconnections required are complex and expensive, and have generally been realized by means of coaxial cables. These coaxial cables or connectors have been awkward to use and have sometimes required excessive time for each change.

In an attempt to solve the above problems, a number of various switch systems have been developed to provide quick and convenient coupling between a plurality of transmitters and a plurality of field antennas. Generally speaking, the switch systems involve a crosspoint matrix wherein a plurality of input lines are arranged parallel to one another in a given plane, for example; and a plurality of output lines are spaced apart, in another plane, from the input lines, being arranged orthogonally to the input lines to form the matrix.

Thus, it is well known to provided radio frequency switches capable of selectively coupling any one of a plurality of transmitters or receivers to any one of a plurality of antennas. These switch systems must be able to handle relatively large power inputs and loads, provide a high degree of isolation, and be capable of selectively switching from one power input to any one of a plurality of loads quickly and conveniently.

One type of switch system is described in U.S. Pat. No. 3,666,902 (Owen et al.), which issued on May 30, 1972, such system including a plurality of input and output lines arranged in a matrix, and a plurality of rotatable connectors.

Another switch system is disclosed in U.S. Pat. No. 3,873,794 (Owen), which issued on Mar. 25, 1975. This patent discloses a switch system intended for use in a radio frequency spectrum, and relates to the switching of connections between coaxial cables wherein the characteristic impedance of the switch system generally conforms to the corresponding impedance of the connecting coaxial cables. This patent includes a matrix configuration with a rotatable switch means mounted at each crosspoint, mechanical and electrical interlocks to prevent multiple connections to any given input or output line, and grounding means. The matrix is formed of a plurality of interchangeable modules to allow quick and convenient expansion of the matrix.

Other examples of conventional switching system are disclosed in U.S. Pat. Nos. 3,717,736 (Kershner et al.), which issued Feb. 20, 1973, 4,025,746 (Owen), which issued May 24, 1977, 4,201,899 (Owen), which issued May 6, 1980, 3,885,117 (Owen), which issued May 20, 1975, 3,584,172 (Owen), which issued Jun. 8, 1971, 3,500,004 (Kershner et al.), which issued Mar. 10, 1970, and 3,588,390 (Kershner et al.), which issued Jun. 28, 1971; and Canadian Pat. No. 804,169 (Wright et al.), which issued Jan. 14, 1969.

The unique configuration of the coaxial crosspoint switch according to the present invention provides a high isolation modular switch which exhibits the following characteristics, thereby providing substantial commercial advantages over conventional switching system: (1) high isolation between different connecting modes or switch positions, (2) simple modular construction, (3) expandable by columns and rows, (4) fast switching between inputs and outputs, (5) fully interlocked, and (6) rows and columns individually bi-directional, i.e. complete flexibility of routing.

The present invention also provides many additional advantages which shall become apparent as described below.

SUMMARY OF THE INVENTION

A radio frequency crosspoint switch module for use in a matrix comprising: a housing adapted to provides grounding; a pair of orthogonally related crosspoint switches disposed within the housing at either end thereof, each crosspoint switch including three movable blade contacts and three sets of fixed contacts, one set of fixed contacts being disposed on, and in contact with, the housing; a pair of coaxial connectors coupled to each of the ends of the housing, each connector having an inner conductor and an outer conductor, each pair of coaxial connectors being disposed on a common axis to be connected in a through connection mode when a respective switch is in a first position, such that two of the movable blade contacts are in contact with the second and third sets of fixed contacts attached to, or forming part of, the inner conductors of the first and second coaxial connectors respectively; a third coaxial connector being rotatable, extending between the ends of the housing, and orthogonally related to the two pairs of coaxial connectors, the third coaxial connector being grounded by way of contact of the one set of fixed contact disposed on the housing with the third of the movable blade contacts, which is affixed to the third coaxial connectors, when said crosspoint switches are in their first or through connection, position; and being connected to one of the other coaxial connectors when the crosspoint switches are in their second or cross connection, position.

The crosspoint switches each include a hub in which the three movable blade contacts are disposed. Each crosspoint switch is operated by a crosspoint drive means which causes rotation of the inner conductor forming part of the cross connector means. This means is like a shaft disposed through the center of each hub such that it may be rotated plus or minus 90 degrees. The shafts are rotated by any suitable motorized or manual drive means.

The three movable blade contacts are disposed about the hub in such a manner that two of the movable blade contact are approximately 180 degrees apart, the third movable blade contact being disposed between the other two movable blade contacts such that it is approximately 90 degrees from each such movable blade contact.

The crosspoint switch module can also comprise auxiliary switches. These auxiliary switches are either interlock switches, readout switches or both.

The present invention also includes a radio frequency crosspoint switch matrix formed by interconnection of a plurality of the unique radio frequency crosspoint switch modules.

In accordance with a crosspoint switch matrix, a plurality of radio frequency sources are connected to respective first coaxial connectors and thence to the modules in one plane of the matrix; and a plurality of radio frequency output devices are connected to respective second coaxial connectors and thence to the modules in another plane of the matrix. The first coaxial connectors are orthogonally related to the second coaxial connectors. In one example to be described, the input sources are transmitters and the output devices are antennas.

Other and further objects, advantages and features of the present invention will be understood by reference to the following specification in conjunction with the annexed drawing, wherein like parts have been given like numbers.

DESCRIPTION OF THE PREFERRED EMBODIMENTS

The crosspoint switch module includes a housing which contains a pair of orthogonally related crosspoint switches. Auxialiary switches can also be included (not seen) for interlock and readout purposes. The modules are connected together to form the rows and columns of a crosspoint switch matrix as required. The exemplary 4×4 matrix of FIG. 1 has sixteen crosspoint switch modules, i.e., four rows by four columns of modules. Additional modules may be added to complete a matrix of any desired number of rows and columns.

The matrices are preferably $1\frac{5}{8}$ and $3\frac{1}{8}$ inch 50 ohm systmes. The switches must be capable of supporting frequencies and power levels equivalent to the transmission line sizes. The input and output connections are easily removable to accommodate an expansion of the matrix or to change coaxial connections. The transmission line system throughout the matrix is coaxial having an outer conductor preferably of aluminum and an inner conductor preferably of high conductivity copper. The radio frequency contacts are preferably silver graphite buttons running against copper and are individually spring loaded to assure proper contact and alignment.

Figure 1:
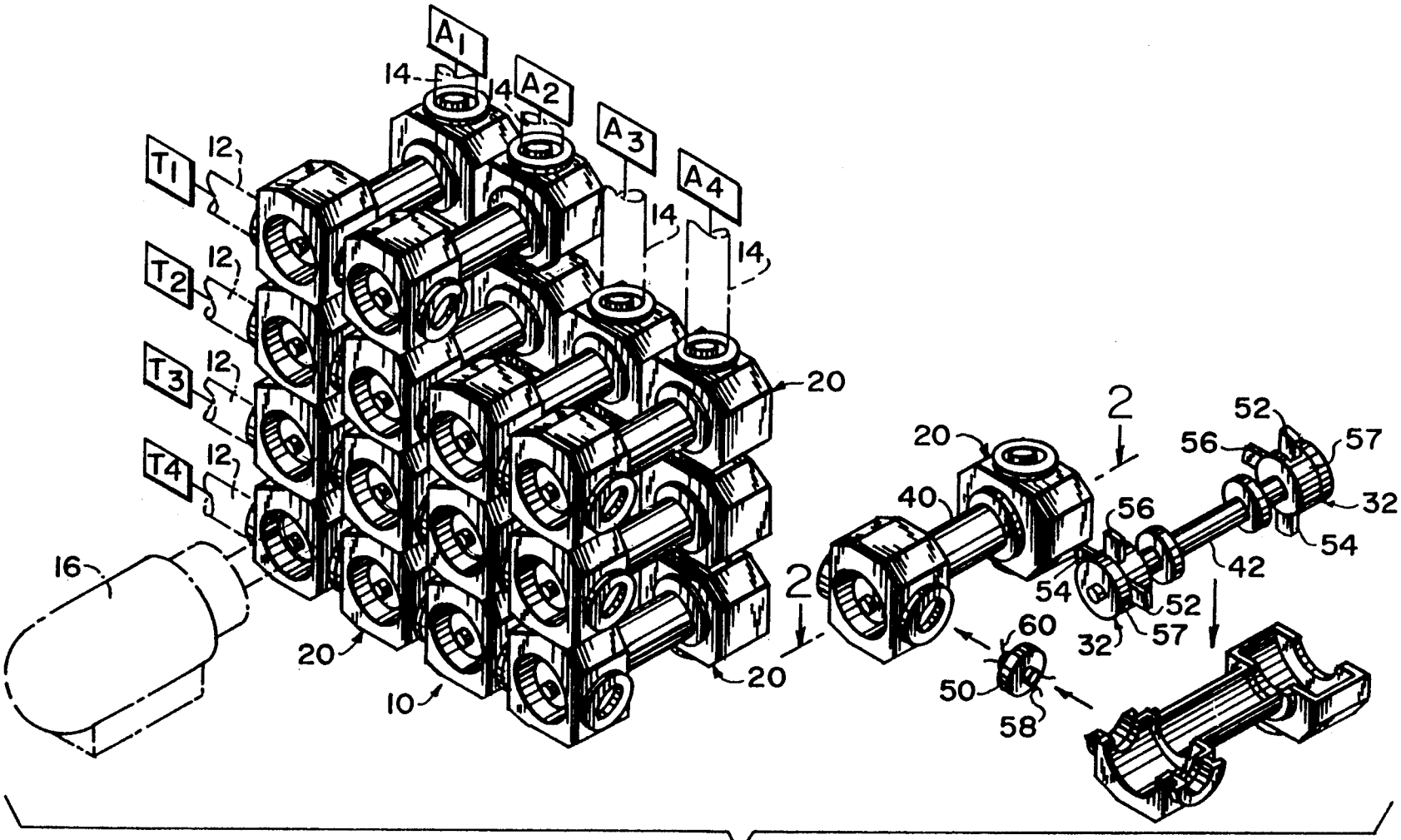
FIG. 1 is a schematic perspective, broken away view of an exemplary 4×4 crosspoint switch matrix in accordance with the present invention, including exploded views of single crosspoint switch modules.

The present invention can best be described by referring to the attached drawings, wherein FIG. 1 depicts a crosspoint switch matrix 10 designed to enable the selective connection of a particular one of the transmitters T1–T2, not shown in detail, to any one of a number of antennas A1–A2, not shown in detail. The assembly is completely modular and the number of crosspoints is limited only by the space available. Shown in phantom in FIG. 1 are an exemplary, input coaxial connector 12, an output coaxial connector 14, and a drive motor 16.

Crosspoint switch matrix 10 functions to perform the required connections, already noted, by selective operation simultaneously of a pair of crosspoint switches 30 within each module of the plurality of crosspoint modules 20 seen in FIG. 1. Each switch 30 has two modes or positions, effectuating either a "through connection" or a "cross connection" to be described.

The horizontal transmission line runs called "rows" extend the complete width of matrix 1. The transmission line runs are represented by the arrows adjacent T1, T2, T3 and T4. The vertical antenna line runs called "columns" extend the full height of matrix 1. The antenna line runs are represented by the arrows adjacent A1, A2, A3, and A4. When a crosspoint switch is placed in a first position, it is said to be "activated", and a row is connected to a column at that crosspoint providing a "cross connection" from an input, i.e., T1, T2, T3 or T4, to an output, i.e., to any one of A1, A2, A3 or A4, connected to matrix 10.

The inputs from a transmitter may be connected to the rows with the antennas connected to the columns or vice versa as the layout of the transmitting facility requires. The direction of the radio frequency path in any row may be from left to right or from right to left as desired. Similarly, the direction of the radio frequency path in a column may be from top to bottom or from bottom to top. This allows complete versatility in the transmission line runs from the transmitters to the matrix as well as the runs from the matrix to the antennas or dummy loads. The crosspoint switches can be installed in the factory for the desired matrix pattern or the crosspoints can be changed in the field to suit.

Each crosspoint switch module 20 includes a housing 22 in which there are disposed its two crosspoint switches 30 (FIG. 2) joined by a short coaxial cross connector 40 extending from one end to the opposite end of the housing. The inner conductor 42 of the connector 40 functions as a rotatable shaft. When a particular row and column are in the "inactive" position, i.e., the particular pair of crosspoint switches 30 are in their first position ("through connection") due to appropriate energization of motor 16, the coaxial cross connector 40 then being grounded on both ends. This produces a high degree of decoupling of a row from a column, thereby to provide extremely high isolation between other inputs and outputs of matrix 10. However, when the given crosspoint switches are in the "activated", or second, position, coaxial cross connector 40 connects row to column; and at that time shields the unused portions of the other row and columns resulting in high isolation between the active path (through connection) and the termination on the row and columns (see "stub" connectors 50 in FIGS. 1 and 2).

Figure 3:
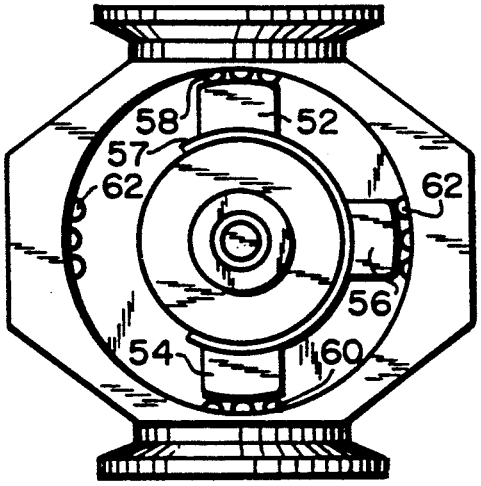
FIG. 3 is an end view of the crosspoint switch module in accordance with the present invention, particularly showing one of the switches as having three movable blade contacts.
Figure 2:
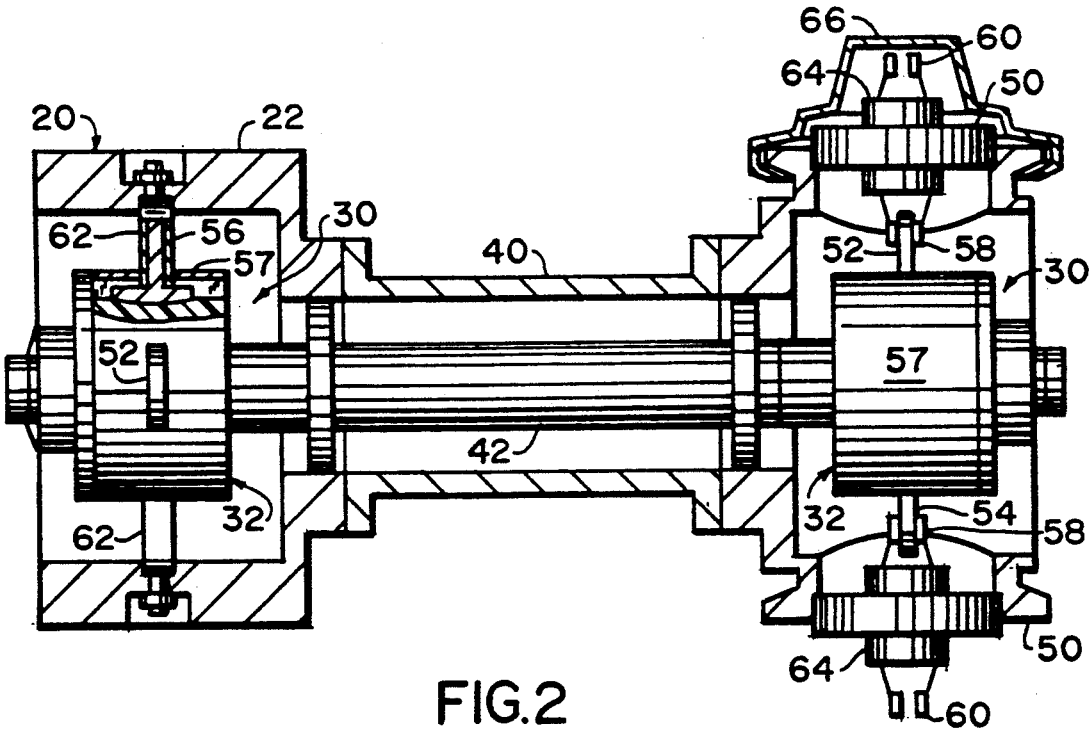
FIG. 2 is a cross-sectional view along line 2—2 of FIG. 1 and particularly depicts the components of a crosspoint switch module.

FIGS. 2 and 3 depict in some detail a crosspoint switch module 20 for use in a matrix. Each crosspoint switch 30 of the pair of the housing 22 includes at least three movable blade contacts 52, 54, and 56, and at least three sets of fixed contacts 58, 60, and 62. Each switch 30 is identical except that one has a 90 degree rotational orientation with respect fo the other. One set of fixed contacts, i.e., contacts 62, are seen attached (on the left in FIG. 2) to the housing 22 so as to be grounded to the housing. The other fixed contacts 58 and 60, which enable the "through connection", form part of the inner conductors 64 of, for example, the stub connectors 50, seen in FIG. 2. A shield or cap 66 is provided to protect the contacts when the module is not in use.

Each of the pair of crosspoint switches 30 includes a hub 32 in which the three movable blade contacts 52, 54, and 56 are mounted (FIG. 1), blade contacts 52 and 54 being electrically connected together by a U-shaped conductive element 57 at the outer periphery of hub 32. Blade contact 56 extends radially inwardly by way of a slot 59 in the hub for attachment to shaft 42. Crosspoint switch 30 is operated by a crosspoint drive means comprising a motor 16 adapted for driving rotatable shaft 42 (inner conductor) through the center of hub 32 such that it may be rotated plus or minus 90 degrees. Movable blade contacts 52, 54, and 56 are disposed about hub 32 in such a manner that movable blade contacts 52 and 54 are approximately 180 degrees apart arcuately and movable blade contact 56 is disposed between movable blade contacts 14 and 15 such that it is approximately 90 degrees from each such movable blade contact.

The crosspoint switch module may also include auxiliary switches, e.g, interlock switches and readout switches (not seen). The auxiliary interlock switches are activated by a driving gear which inherently has a "dwell" position on each end of the travel. This dwell provides an extended time period between the activation of the radio frequency contacts and the interlock switches. This time assure that the radio frequency contacts are properly connected before the transmitter is turned on as well as it provides sufficient time to shut the transmitter off before the radio frequency contact opens, should a crosspoint switch be inadvertently changed while under power. The crosspoint switch can be provided as a manufal unit or it can be equipped with a 24 volt DC motor. The motor operates the switch in less than one second after receipt of the drive voltage. Both the manual and motorized versions of the switch are complete with interlock switches and visual position indicators. The manual version can be converted to motorized in the field if required.

An additional auxiliary switch attachment can be added to any of the crosspoint switches to provide independent circuitry for integration with other control equipment. This switch package is connected to the crosspoint rotor at the rear of the matrix and can contain up to four form C contacts at both the inactive and the active positions of the crosspoint. These auxiliary switches can be used for independent hard wired interlocks or control functions.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of appended claims.

What is claimed is:

1. A radio frequency crosspoint switch module for use in a matrix having rows and columns comprising:

a housing adapated to provide grounding, and thereby to produce a high degree of isolation between the rows and columns;

a pair of orthogonally related crosspoint switches disposed within said housing at either end thereof, each crosspoint switch including three movable blade contacts and three sets of fixed contacts, one set of fixed contacts being disposed on and in contact with said housing;

a pair of coaxial connectors coupled to each of said ends of said housing, each connector having an inner conductor and an outer conductor, each pair of coaxial connectors being disposed on a common axis to be connected in a through connection mode when a respective switch is in a first position, such that two of said movable blade contacts are in contact with the second and third sets of fixed contacts attached to, or forming part of, inner conductors of said first and second connectors respectively;

a third coaxial connector being rotatable, extending between the ends of said housing, and orthogonally related to said two pairs of coaxial connectors, said third coaxial connector being grounded by way of contact of said one set of fixed contacts disposed on said housing with the third of said movable blade contacts, which is affixed to said third coaxial connector, when said crosspoint switches are in their first position, and being connected to one of said other coaxial connectors when said crosspoint switches are in their second, or cross connection, position.

2. A crosspoint switch module according to claim 1 wherein said fixed contacts on said housing are grounded.

3. A crosspoint switch module according to claim 1 wherein said inner conductor of said coaxial connector is made from high conductivity copper and said outer conductor of said coaxial connector is made from aluminum.

4. A crosspoint switch module according to claim 1 wherein each of said crosspoint switches includes a hub in which said three movable blade contacts are mounted.

5. A crosspoint switch module according to claim 4 wherein said three movable blade contacts are disposed about said hub in such a manner that two of said movable blade contact are approximately 180° apart and wherein a third movable blade contact is disposed between the other two movable blade contacts such that it is approximately 90° from each such movable blade contact.

6. A crosspoint switch module according to claim 4 wherein said hub is driven either by a drive motor or by manual means.

7. A crosspoint switch module according to claim 4 wherein each crosspoint switch is operated by a crosspoint drive means.

8. A crosspoint switch module according to claim 7 wherein said crosspoint drive means is a shaft disposed through the center of said hub such that it may be rotated plus or minus 90°.

9. A radio frequency crosspoint switch matrix having rows and columns and formed by interconnection of a plurality of radio frequency crosspoint switch modules, said crosspoint switch modules each comprising:

a housing adapted to provide grounding, and thereby to produce a high degree of isolation between the rows and columns;

a pair of orthogonally related crosspoint switches disposed within said housing at either end thereof, each said crosspoint switch including at least three movable blade contacts and at least three sets of fixed contacts, at least one set of fixed contacts being disposed on and in contact with said housing;

a pair of coaxial connectors coupled to each of said ends of said housing, each connector having an inner conductor and an outer conductor, each pair of coaxial connectors being disposed on a common axis to be connected in a through connection mode when a respective switch is in a first position, such that two of said movable blade contacts are in contact with the second and third sets of fixed contacts attached to, or forming part of, the inner conductors of said first and second connectors respectively;

a third coaxial connector being rotatable, extending between the ends of said housing and orthogonally related to said two pairs of coaxial connectors, said third coaxial connector being grounded by way of contact of said one set of fixed contacts disposed on said housing with the third of said movable blade contacts when said crosspoint switches are in their first position, and being connected to one of said other coaxial connectors when said crosspoint switches is in their second position.

10. A crosspoint switch matrix according to claim 9 wherein a plurality of radio frequency sources connected to respective first coaxial connectors and modules in one plane of said matrix, and a plurality of radio frequency output devices connected to respective second coaxial connectors in another plane of said matrix, said first coaxial connectors being orthogonally related to said second coaxial connectors.

11. A crosspoint switch matrix according to claim 10 wherein said input sources are transmitters and said output devices are antennas.

* * * * *